US008118459B2

(12) United States Patent
Eberhardt et al.

(10) Patent No.: US 8,118,459 B2
(45) Date of Patent: Feb. 21, 2012

(54) VEHICLE HEADLIGHT

(75) Inventors: Stefan Eberhardt, Backnang (DE); Burkhard Leutiger, Karlsruhe (DE); Heinz Redlich, Vaihingen-Enz (DE)

(73) Assignee: Dr. Inh. h.c. F. Porsche Aktiengesellschaft, Stuttgart (DE)

( * ) Notice: Subject to any disclaimer, the term of this patent is extended or adjusted under 35 U.S.C. 154(b) by 254 days.

(21) Appl. No.: 12/354,279

(22) Filed: Jan. 15, 2009

(65) Prior Publication Data

US 2009/0180293 A1 Jul. 16, 2009

(30) Foreign Application Priority Data

Jan. 15, 2008 (DE) ..... 10 2008 004 353

(51) Int. Cl.
*F21V 7/00* (2006.01)

(52) U.S. Cl. ..... 362/346; 362/304

(58) Field of Classification Search ..... 362/297–304, 362/326–328, 331–335, 342, 343, 346, 347, 362/296.01
See application file for complete search history.

(56) References Cited

U.S. PATENT DOCUMENTS

| | | | | |
|---|---|---|---|---|
| 1,700,760 | A * | 2/1929 | Brewer | 362/245 |
| 2,280,275 | A * | 4/1942 | Young | 362/300 |
| 3,267,279 | A * | 8/1966 | Doolittle | 362/268 |
| 3,331,617 | A * | 7/1967 | Jacoby | 280/279 |
| 7,325,954 | B2 * | 2/2008 | Futami | 362/538 |
| 2005/0201117 | A1 * | 9/2005 | Sugimoto et al. | 362/539 |
| 2006/0133094 | A1 * | 6/2006 | Yang | 362/346 |
| 2006/0250811 | A1 * | 11/2006 | Wu et al. | 362/539 |

* cited by examiner

*Primary Examiner* — Julie Shallenberger

(57) ABSTRACT

A vehicle headlight has at least one lens module. The lens module, or each lens module, respectively has a lighting device and a projection lens. Accordingly, at least two lens modules are positioned one on top of the other and at least one reflector is positioned between, in each case, two lens modules which are positioned one on top of the other.

9 Claims, 2 Drawing Sheets

VEHICLE HEADLIGHT

CROSS-REFERENCE TO RELATED APPLICATION

This application claims the priority, under 35 U.S.C. §119, of German application DE 10 2008 004 353.2, filed Jan. 15, 2008; the prior application is herewith incorporated by reference in its entirety.

BACKGROUND OF THE INVENTION

Field of the Invention

The invention relates to a vehicle headlight containing a lens module having a lighting device and a projection lens.

Motor vehicles have a large number of lighting devices, specifically lighting devices for illuminating an interior space of a motor vehicle or an assembly which is assigned to the interior space of the motor vehicle, and lighting devices for illuminating an area in the surroundings of the motor vehicle. The lighting devices which are used to illuminate the area in the surroundings of the motor vehicle include, in particular, what are referred to as vehicle headlights, are used to illuminate a roadway of the motor vehicle. Vehicle headlights include, inter alia, reversing headlights and headlamps with different functions such as dipped headlight, floodlight, full beam, freeway light or the like.

Vehicle headlights which are known from practice usually have at least one lens module, wherein a lens module contains a lighting device and a projection lens. In particular in the case of vehicle headlights with a high degree of inclination of a covering lens of the vehicle headlight, the optimum illumination of the roadway provides difficulties since light beams are shaded at the side of the housing.

SUMMARY OF THE INVENTION

It is accordingly an object of the invention to provide a vehicle headlight which overcomes the above-mentioned disadvantages of the prior art devices of this general type, which provides a novel vehicle headlight.

With the foregoing and other objects in view there is provided, in accordance with the invention, a vehicle headlight. The headlight contains lens modules each having a lighting device and a projection lens. At least two of the lens modules are disposed one on top of the other. At least one reflector is disposed between, in each case, the two lens modules being disposed one on top of the other.

According to the invention, at least two lens modules are positioned one on top of the other, wherein at least one reflector is positioned between, in each case, two lens modules which are positioned one on top of the other.

The invention proposes for the first time that at least one reflector be positioned between two lens modules, positioned one on top of the other, of a vehicle headlight. By utilizing the free space between the two lens modules by the reflector, or each reflector, a minimum installation space of the vehicle headlight and optimum illumination of the roadway can be implemented. Even if the vehicle headlight has a very highly inclined covering lens, good illumination of the roadway is possible.

According to one advantageous development of the invention, two reflectors are positioned between, in each case, two lens modules which are positioned one on top of the other, preferably laterally next to the lens modules, so that a left-hand roadway region can be illuminated using a reflector or reflector component which is positioned to the right next to the lens modules, and a right-hand roadway region can be illuminated using a reflector or reflector component which is positioned to the left next to the lens modules.

This crosswise illumination of the roadway using the vehicle headlight according to the invention ensures, in particular, optimum illumination of the sides of the roadway.

The reflectors are preferably positioned between, in each case, two lens modules which are positioned one on top of the other, in such a way that axes of symmetry, which extend transversely with respect to the longitudinal axis of the vehicle and horizontally, of the reflectors pass through a free space which extends between the respective lens modules.

Other features which are considered as characteristic for the invention are set forth in the appended claims.

Although the invention is illustrated and described herein as embodied in a vehicle headlight, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The present invention relates to a vehicle headlight of a motor vehicle, wherein a vehicle headlight is used to illuminate a roadway of the motor vehicle.

The vehicle headlight can be a reversing headlight or a headlamp or a dipped headlight or some other headlight for illuminating the roadway of the motor vehicle.

Figure 1:
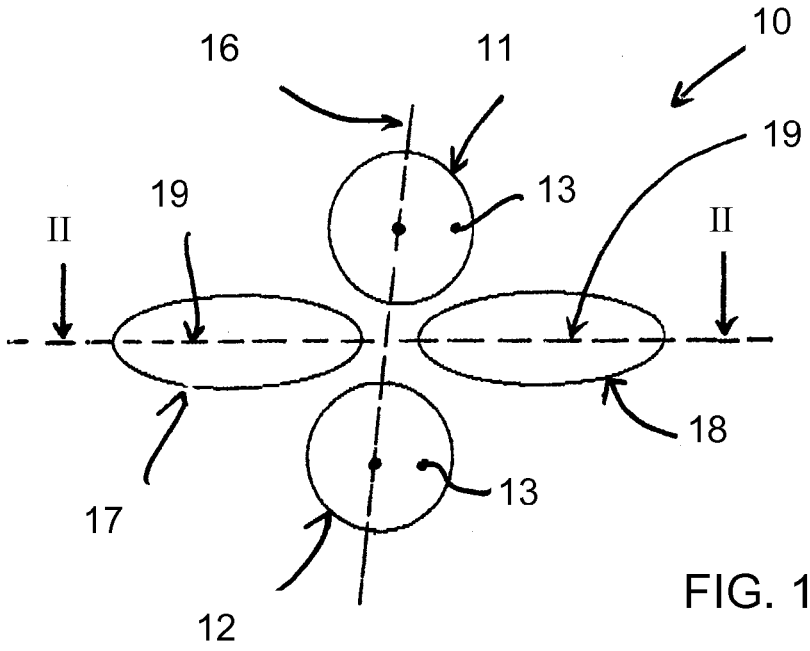
FIG. 1 is a schematic illustration of a vehicle headlight according to a first exemplary embodiment of the invention.

Referring now to the figures of the drawing in detail and first, particularly, to FIG. 1 thereof, there is shown a schematic front view of a vehicle headlight 10 according to a first exemplary embodiment of the invention, wherein, in the exemplary embodiment shown, the vehicle headlight 10 has two lens modules 11, 12 which are positioned one on top of the other. Each of the lens modules 11, 12 has a projection lens 13 and a lighting device 14, and the lighting device 14 is preferably embodied as LED lighting device with at least one LED. According to FIG. 2, the lighting device 14 shown in FIG. 2 for the lens module 11 has two LEDs 15.

According to FIG. 1, the two lens modules 11, 12 are positioned one on top of the other in such a way that center points of the lens modules 11, 12 lie on an axis 16 which is positioned obliquely with respect to a vertically extending axis (not illustrated). The two lens modules 11, 12 are accordingly spaced apart in the vertical direction, on the one hand, and offset transversely with respect to the longitudinal axis of the vehicle in the horizontal direction, on the other. Furthermore, the two lens modules 11, 12 can be offset with respect to one another horizontally in the direction of the longitudinal axis of the vehicle.

Two reflectors 17 and 18 are positioned between the two lens modules 11, 12 which are positioned vertically one on top of the other. The two reflectors 17, 18 are positioned here between, and preferably laterally next to, the two lens modules 11, 12 in such a way that a right-hand roadway region can be illuminated using the left-hand reflector 17 shown in FIG. 1, and a left-hand roadway region can be illuminated using the right-hand reflector 18 shown in FIG. 1.

According to FIG. 1, the reflectors 17, 18 are arranged between the two lens modules 11, 12 which are positioned one on top of the other, in such a way that axes of symmetry 19, extending transversely with respect to the longitudinal axis of the vehicle and horizontally, of the reflectors 17, 18 extend through a free space which extends between the lens modules 11, 12, or through a gap formed between the two lens modules 11, 12.

The free space or the gap between the two lens modules 11, 12 which are positioned vertically one on top of the other is accordingly utilized by the reflectors 18, 19 for criss-cross lateral illumination of the roadway of the motor vehicle.

In the exemplary embodiment in FIG. 1, the axes of symmetry 19 of the two reflectors 17, 18 coincide.

The lenses 13 of the lens modules 11, 12 have a circular contour. In contrast, in the exemplary embodiment in FIG. 1, the reflectors 17, 18 have an oval contour.

Figure 2:
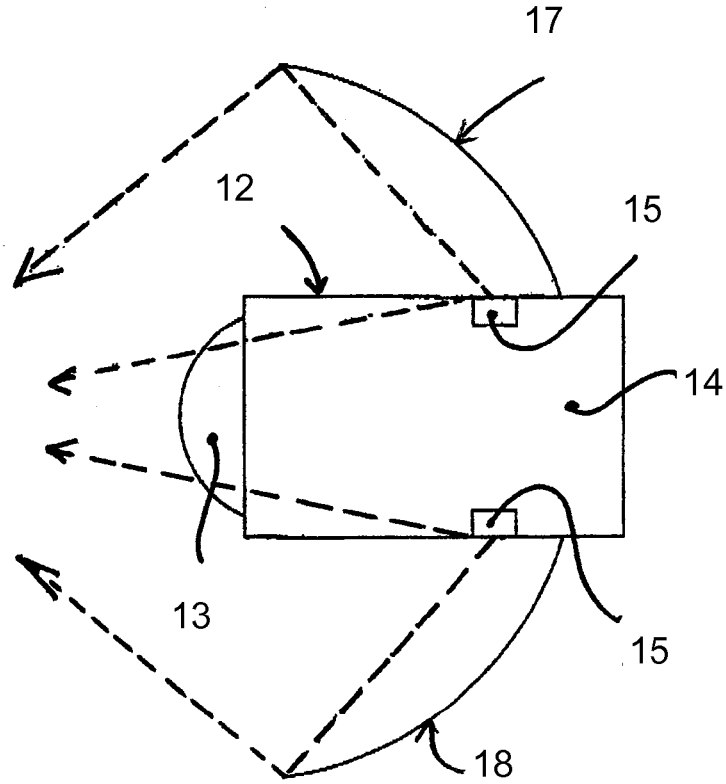
FIG. 2 is an illustration showing the vehicle headlight according to FIG. 1 in a viewing direction 11.
Figure 3:
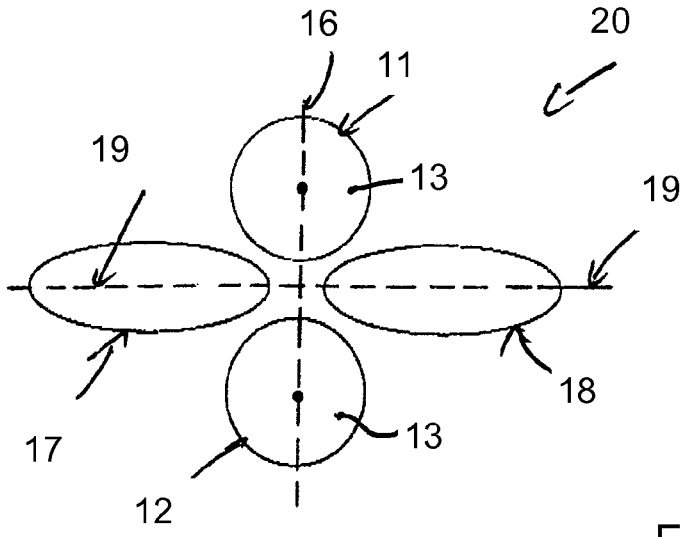
FIG. 3 is a schematic illustration of the vehicle headlight according to a second exemplary embodiment of the invention.
Figure 4:
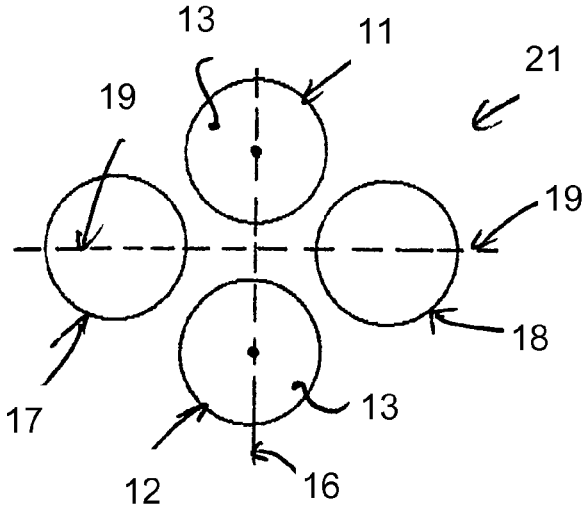
FIG. 4 is a schematic illustration of the vehicle headlight according to a third exemplary embodiment of the invention.
Figure 5:
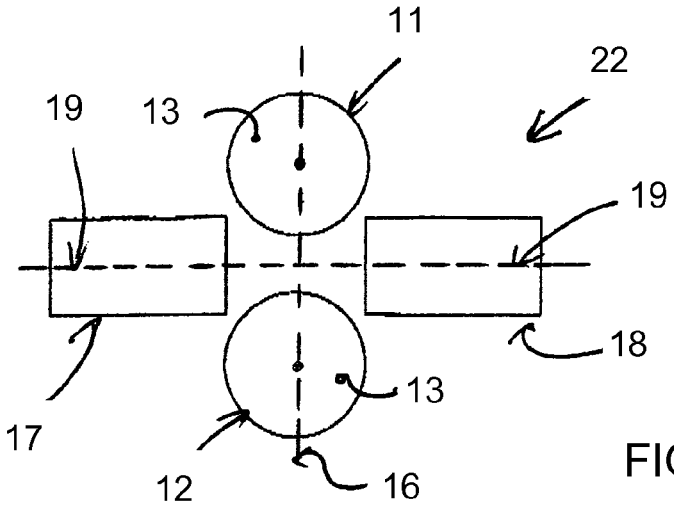
FIG. 5 is a schematic illustration of the vehicle headlight according to a fourth exemplary embodiment of the invention.

FIGS. 3 to 5 show further exemplary embodiments of vehicle headlights 20, 21 and 22 according to the invention, which headlights 20, 21 and 22 correspond in terms of their basic design to the vehicle headlight 10 in FIGS. 1, 2 for which reason identical reference symbols are used for identical assemblies in order to avoid unnecessary repetitions, and only details in which the exemplary embodiments in FIGS. 3 to 5 differ from the exemplary embodiment in FIGS. 1, 2 are examined in more detail below.

The exemplary embodiment in FIG. 3 therefore differs from the exemplary embodiment in FIGS. 1, 2 in that in the exemplary embodiment in FIG. 3, the center points of the lens modules 11, 12 lie on a vertically extending axis 16. In the exemplary embodiment in FIG. 3, the two lens modules 11, 12 are accordingly not offset transversely with respect to the longitudinal direction of the motor vehicle in the horizontal direction.

The exemplary embodiments in FIGS. 4 and 5 differ from the exemplary embodiment in FIG. 3, and accordingly from the exemplary embodiment in FIGS. 1 and 2, through the contouring of the reflectors 17, 18. For example, in the exemplary embodiment in FIG. 4 the reflectors 17, 18 have a circular contour, and in the exemplary embodiment in FIG. 5 they have a rectangular contour.

In contrast to the exemplary embodiments shown in FIGS. 1 to 5, it is possible for the axes of symmetry 19 of the reflectors 17, 18 not to coincide but rather to be offset with respect to one another and to extend parallel to one another. In this case, the reflectors 17, 18 are offset with respect to one another in the vertical direction.

In addition, in contrast to the exemplary embodiments shown it is possible to position a reflector exclusively between, in each case, two lens modules which are positioned one on top of the other. The embodiment of the invention shown, with two reflectors which are positioned laterally next to the lens modules 11, 12 on different sides thereof, is however preferred.

In the exemplary embodiments shown, the reflectors are positioned at least for the most part laterally next to the lens modules. The reflectors can also completely fill the free space between the lens modules. The decisive factor is that the reflector, or each reflector, utilizes the free space or the gap between the lens modules for illumination.

The invention claimed is:

1. A vehicle headlight, comprising:

lens modules each having a lighting device and a projection lens, at least two of said lens modules disposed in a plane and such that one of said two lens modules is disposed at a height above the top portion of the other, said lens modules having center points that lie on an axis which is disposed obliquely with respect to a vertically extending axis in said plane; and at least one reflector disposed between, in each case, said two lens modules, said reflector having first and second reflectors disposed between, in each case, said two lens modules, so that a left-hand roadway region is illuminated using said first reflector or a reflector component of said first reflector which is disposed to the right next to said lens modules, and a right-hand roadway region is illuminated using said second reflector or a reflector component of said second reflector which is disposed to the left next to said lens modules.

2. The vehicle headlight according to claim 1, wherein said lens modules have center points disposed one on top of the other and lie on a vertically extending axis.

3. The vehicle headlight according to claim 1, wherein said reflectors are disposed between, in each case, said two lens modules, in such a way that axes of symmetry, which extend transversely with respect to a longitudinal axis of a vehicle and horizontally, of said reflectors pass through a free space which extends between respective ones of said lens modules.

4. The vehicle headlight according to claim 3, wherein the axes of symmetry of said first and second reflectors which are disposed between, in each case, said two lens modules, coincide.

5. The vehicle headlight according to claim 3, wherein the axes of symmetry of said first and second reflectors which are disposed between, in each case, said two lens modules, extend in parallel.

6. The vehicle headlight according to claim 1, wherein said reflector which is disposed between, in each case, said two lens modules, has a circular contour.

7. The vehicle headlight according to claim 1, wherein said reflector which is disposed between, in each case, said two lens modules, has an oval contour.

8. The vehicle headlight according to claim 1, wherein said reflector which is disposed between, in each case, two of said lens modules, has a rectangular contour.

9. The vehicle headlight according to claim 1, wherein said lens modules which are disposed one on top of the other are offset with respect to one another in a direction of a longitudinal axis of the vehicle.

* * * * *